US011454434B2

(12) United States Patent
Sus et al.

(10) Patent No.: US 11,454,434 B2
(45) Date of Patent: Sep. 27, 2022

(54) HEAT EXCHANGER MODULE WITH A BRACKET FOR HOLDING A RECEIVER DRIER

(71) Applicant: Valeo Autosystemy Sp. z o.o., Skawina (PL)

(72) Inventors: Pawel Sus, Bietigheim-Bissingen (DE); Mateusz Kaczmarczyk, Skawina (PL); Karol Pokrywinski, Skawina (PL)

(73) Assignee: Valeo Autosystemy Sp. z o.o., Skawina (PL)

( * ) Notice: Subject to any disclaimer, the term of this patent is extended or adjusted under 35 U.S.C. 154(b) by 247 days.

(21) Appl. No.: 16/638,651

(22) PCT Filed: Aug. 14, 2018

(86) PCT No.: PCT/EP2018/072004
§ 371 (c)(1),
(2) Date: Feb. 12, 2020

(87) PCT Pub. No.: WO2019/034643
PCT Pub. Date: Feb. 21, 2019

(65) Prior Publication Data

US 2021/0131710 A1 May 6, 2021

(30) Foreign Application Priority Data

Aug. 17, 2017 (EP) ..... 17461590

(51) Int. Cl.
*F25B 39/04* (2006.01)

(52) U.S. Cl.
CPC ..... *F25B 39/04* (2013.01); *F25B 2339/0442* (2013.01); *F25B 2339/0446* (2013.01)

(58) Field of Classification Search
CPC ..... F25B 39/04; F25B 43/00; F25B 43/003; F25B 2339/044; F25B 2339/0442; F25B 2339/0446; F25B 2400/24
See application file for complete search history.

(56) References Cited

U.S. PATENT DOCUMENTS 6,889,521 B2 * 5/2005 Seno ..... F28F 9/0246 62/506
7,712,330 B2 * 5/2010 Hosokawa ..... F25B 43/003 62/509

(Continued)

FOREIGN PATENT DOCUMENTS

CN 1494649 A 5/2004
CN 203364512 U 12/2013

(Continued)

OTHER PUBLICATIONS

Machine translation of WO 2007141982 (Year: 2007).*

(Continued)

*Primary Examiner* — Joseph F Trpisovsky
(74) *Attorney, Agent, or Firm* — Osha Bergman Watanabe & Burton LLP

(57) ABSTRACT

A heat exchanging module includes a heat exchanger, a frame, and a bottle. The heat exchanger may be attached to the frame. The bottle may be attached to the heat exchanger by a first attachment mean at a first portion of the bottle. Additionally, the bottle may be attached to the frame with a second attachment mean located at a second portion of the bottle.

20 Claims, 5 Drawing Sheets

(56) References Cited

U.S. PATENT DOCUMENTS

| | | | |
|---|---|---|---|
| 2003/0011991 | A1 | 1/2003 | Peng et al. |
| 2007/0115638 | A1 | 5/2007 | Yu et al. |

FOREIGN PATENT DOCUMENTS

| | | | |
|---|---|---|---|
| CN | 204100657 | U | 1/2015 |
| EP | 2960613 | A1 | 12/2015 |
| EP | 3026251 | A1 | 6/2016 |
| JP | H08-75317 | A | 3/1996 |
| JP | H08-219589 | A | 8/1996 |
| JP | 2007132631 | A | 5/2007 |
| JP | 4719555 | B2 | 7/2011 |
| WO | 2007141982 | A1 | 12/2007 |
| WO | 2010108907 | A1 | 9/2010 |

OTHER PUBLICATIONS

Machine translation of WO 2010108907 (Year: 2010).*
The First Office Action in corresponding Chinese Application No. 201880063980.6, dated May 7, 2021 (14 pages).
International Search Report and Written Opinion in corresponding International Application No. PCT/EP2018/072004, dated Oct. 18, 2018 (9 pages).
Communication from the Examining Division in corresponding European Application No. 17 461 590.6, dated Aug. 17, 2021 (8 pages).

* cited by examiner

HEAT EXCHANGER MODULE WITH A BRACKET FOR HOLDING A RECEIVER DRIER

BACKGROUND

The present invention relates to heat exchangers, especially heat exchangers used in air conditioning systems for automotive vehicle.

Heat exchangers, and particularly liquid-cooled condensers, are designed to enable the circulation of a coolant fluid and a refrigerant fluid in adjacent but yet separated spaces, to allow the exchange of heat between the fluids. These exchanges cause a change in the state of the refrigerant fluid, from gas to liquid. The refrigerant fluid is pumped through the refrigerant circuit by a compressor, which can only accept the refrigerant fluid in a gas state.

A receiver drier bottle is implemented in the refrigerant fluid circuit to collect and trap liquid and moisture out of the refrigerant fluid, as well as for filtering purposes. Due to the way this bottle is attached to a heat exchanger, the bottle tends to vibrate, which can cause damage to the junction between the bottle and the heat exchanger on which it is located.

Some solutions were developed to solve this problem. Unfortunately, said solutions do not fulfill their aim entirely, as they either consume a lot of space, a scarce resource in an engine compartment, or require altering or designing an entire new way to hold the bottle.

SUMMARY OF DISCLOSURE

The invention aims at offering an alternative to the existing yet incomplete solutions to the problem exposed hereabove, by allowing a compact and efficient attachment of the bottle on the heat exchanging module without the need to modify any part of the air conditioning system; and which ensure a minimal space consumption.

An object of present invention is a heat exchanging module comprising a heat exchanger, a frame and a bottle, the heat exchanger being attached to the frame, the bottle being attached to the heat exchanger by a first attachment means at a first portion of the bottle, the bottle being attached to the frame with a second attachment mean located at a second portion of the bottle.

A heat exchanging module according to this description allow the restriction of the movement of the bottle whatever the vibration the bottle may have to suffer, without a space-costly arrangement of the refrigerant fluid circuit. An additional advantage of this invention is that the modification of the heat exchanging module necessary to the accommodation of the invention is minimal, which allows to cut the cost of conception. Yet another advantage lies in the fact that the second attachment mean does not damage the bottle, either during its set-up or if the elements need to be separated for maintenance or replacement.

The heat exchanging module according to the invention comprises at least one of the following parameters, either alone or in combination with another:

- the second attachment mean restricts a movement of the bottle in a direction perpendicular to the axial dimension of the bottle. The axial dimension of the bottle is the direction along which the bottle extends in its largest dimension; said in other words, the axial direction of the bottle crosses the first attachment means and a terminal end of the bottle;

- the second attachment mean limits an axial movement of the bottle along an axial dimension of said bottle;
- the second attachment mean comprises at least one portion extending in a plane perpendicular to an axial dimension of said bottle;
- said portion is located at a longitudinal end of the bottle. The portion covers at least partially said longitudinal end. Said portion abuts against a terminal end of the bottle; Said longitudinal end is located at an opposite position of the first attachment mean of bottle onto the heat exchanger;
- the second attachment mean comprises a stop portion extending in a plane perpendicular to the axial dimension of the bottle and abutting against a terminal end of the bottle;
- said portion comprises at least two radial projections separated from one another by a gap. In another embodiment, the portion comprises more than two radial projections, two radial projections being separated from one another by a gap. In an embodiment, said radial projection are arranged regularly around the portion;
- the first attachment mean comprises a mounting bracket and a mounting mean, the mounting bracket comprising at least one duct which connect the bottle to the heat exchanger. In an embodiment, the mounting mean is a screw and there are two ducts arranged inside the mounting bracket;
- the second attachment mean comprises a circular portion meant to fit at least partially around the bottle;
- in a particular embodiment, the circular portion fit all around the bottle on a given plane. Said given plane is perpendicular to the axial dimension of the bottle. The bottle is entirely encircled by the circular portion on at least one section of the bottle, without interruption;
- in another embodiment, the circular portion fit only partially around the bottle on a given plane. Said given plane is perpendicular to the axial dimension of the bottle. The circular portion leaves a gap on the bottle where said bottle is free from the circular portion. The circular portion may be combined with the portion that abuts against a terminal end of the bottle and that extends in a plane perpendicular to the axial dimension of the bottle;
- the second attachment mean comprises a first connection mean, and a second connection mean, both first connection mean and second connection mean being connected to the frame;
- the frame comprises at least a side wall and an end wall, the second attachment mean is connected to the side wall of the frame by the first connection mean, and to the end wall of the frame by the second connection mean. The end wall is the part of the frame which is located at the opposite side of the heat exchanger compared to the bottle. The side wall of the frame extends perpendicularly to the end wall of the frame;
- the frame comprises at least a first side wall, a second side wall and an end wall in between said first side wall and said second side wall, the second attachment mean is connected to the first side wall of the frame by the first connection mean, and to the second side wall of the frame by the second connection mean. The first side wall and the second side wall extend parallelly each other. The first side wall of the frame extends on a first side of the heat exchanger, the second side wall of the frame extending on a second side of the heat exchanger opposed to said first side of the heat exchanger;

the first connection mean extends in a first direction while the second connection mean extends in a second direction perpendicular to the first direction. First connection mean extends toward the first attachment mean, while the second attachment mean extends toward the end wall of the frame;

the first connection mean and the second connection mean extend in opposite sense in a parallel direction. First connection mean extends toward the first attachment mean, while the second attachment mean extends away from the first attachment mean;

the first connection mean comprises a mounting clip. In another embodiment, first connection mean comprises a hook;

the second connection mean comprises a screw. In another embodiment, second connection mean comprises a click-in mean;

the second attachment mean comprises a first free end and a second free end, both the first free end and the second free end being connected together by the second connection mean. Both first free end and second free end are connected to frame;

the second attachment mean comprises at least one securing mean that secures the bottle on the second attachment mean;

the securing mean comprising at least one mounting clip, and at least one groove which at least partially receives the mounting clip. In a particular embodiment, the mounting clip is located on the second attachment mean, the groove being located on the bottle;

the second attachment mean is designed to equally accommodate a first type of bottle of a first diameter or a second type of bottle of a second diameter greater than the first diameter;

the frame is made of metal and/or synthetic material. In a particular embodiment, a part of the frame is made of metal, another part being made of synthetic material;

the connection between the second attachment mean and the frame is reversible. Said reversible connection means either the second attachment mean or the bottle can be replaced without having to replace the other element;

the second attachment mean is made of a material having vibration dampening properties;

the second attachment mean is made of synthetic material;

the heat exchanger is crossed by a first circuit configured to receive a refrigerant fluid and by a second circuit configured to receive a coolant fluid.

BRIEF DESCRIPTION OF DRAWINGS

Other characteristics, details and advantages of the invention can be inferred from the description of the invention hereunder. Various embodiments are represented in the figures, wherein.

In the following description, the axial dimension refers to the dimension along which extends the bottle in its greatest dimension. This axial dimension is represented by reference 5 in the various drawings that will be detailed below.

DETAILED DESCRIPTION

Figure 1:
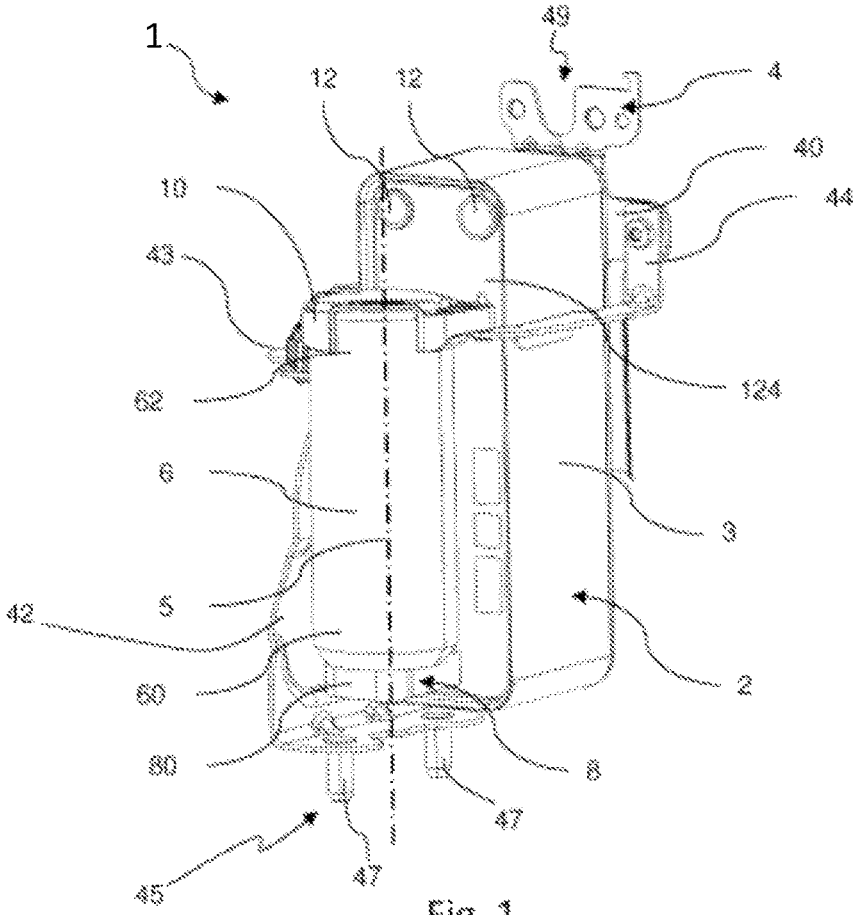
FIG. 1 features a perspective view of a heat exchanging module comprising a second attachment mean according to a first embodiment.

FIG. 1 represents a heat exchanging module 1 according to the invention and having a fame 4, a heat exchanger 2 and a bottle 6.

The heat exchanger 2 is designed to allow the circulation of a refrigerant fluid and a coolant fluid in two separated but adjacent spaces, to allow a heat exchange between the fluids. To do so, the heat exchanger 2 comprises at least four fluid openings 12, two of them being visible on FIG. 1. The exchange of heat between the fluids take place in a body 3 of the heat exchanger 2. The heat exchanger is designed to operate heat exchange only between the refrigerant fluid and the coolant fluids. In other words, the heat exchanger is not adapted to operate exchange between coolant fluid and air, or fluid refrigerant and air.

The bottle 6 is tube-shaped, and is designed to collect and trap moisture out of a fluid which circulate inside of it. The bottle 6 is receiver drier for an AC loop used in vehicle.

Said bottle 6 is connected to the heat exchanger 2 by a first attachment mean 8. The attachment of the bottle 6 through the first attachment mean 8 is located at a first portion 60 of the bottle 6. In this embodiment, first attachment mean 8 comprises a mounting bracket 80 which support the bottle 6 and a mounting screw which secure the bottle 6 onto the mounting bracket 80. The mounting bracket 80 is connected to the heat exchanger 2 and include at least one duct. Said duct is designed to allow the flow of at least one fluid from the heat exchanger 2 to the bottle 6, or from the bottle 6 to the heat exchanger 2 or to another element.

The heat exchanging module 1 further comprises a frame 4 designed to allow the fastening of the heat exchanger 2 and of the bottle 6, and of other elements of the heat exchanging module 1, or the fastening of the heat exchanging module 1 to an external support, for example a body of a vehicle. In this embodiment, said frame 4 comprises an end wall 40, a side wall 42 and a mounting arm 44. According to this embodiment, the frame 4 is made of metal.

The end wall 40 lies on a side of the heat exchanger 2 opposed to the bottle 6, and extend in a first plane. The side wall 42 extends in a second plane which is perpendicular to the first plane. The side wall 42 comprises a bended zone 43 that is collaborating with a second attachment mean 10.

A mounting arm 44 is an extension of the end wall 40, and connects to the end wall 40 by a mounting mean which can be a screw, a mounting clip or any other type of mounting mean. Different mounting arms 44 allow to add different types of second attachment mean 10.

The frame 4 is also comprising a supporting area 45 which can be made by an extension of the side wall 42 or of the end wall 40. The supporting area 45 comprise at least one finger 47, here two fingers, that allows a sliding fastening of the heat exchanging module on the vehicle. The end wall 40 comprises a fixation area 49 dedicated to attachment of the frame 4 on the body of the vehicle.

The bottle 6 is also connected to the frame 4 through the second attachment mean 10. Said second attachment mean 10 is located at a second portion 62 of the bottle 6, said second portion 62 being located at the opposite of the first portion 60 of the bottle 6 along the axial dimension 5.

The second attachment mean 10 is connected to the frame 4, and specifically to the side wall 42 on one hand and to the end wall 40 through the mounting arm 44 on the other hand, in particular via the bended zone 43 and via the mounting arm 44.

Figure 2:
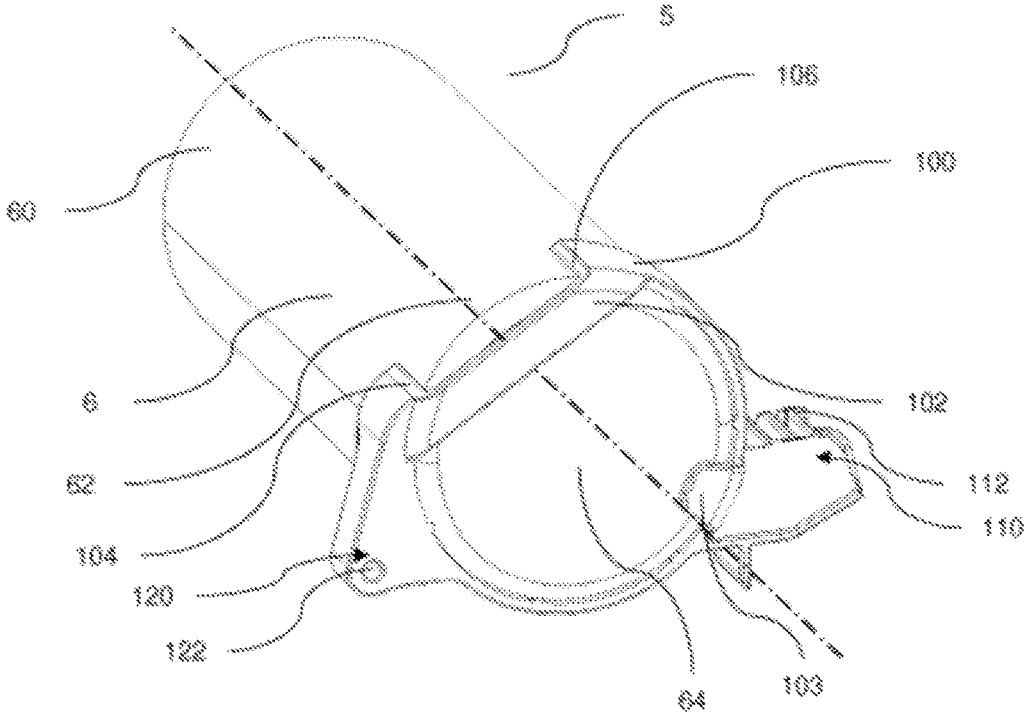
FIG. 2 is a perspective view of a bottle on which is located the second attachment mean.

FIG. 2 features more specifically the bottle 6 and the second attachment mean 10.

The second attachment mean 10 have a circular portion 100 which partially circle the bottle 6. A first connection mean 110 and a second connection mean 120 are made on the circular portion 100. Said first and second connection means are radially oriented with regards to the circular portion 100. Said first connection mean 110 globally extends radially and parallel to the axial dimension 5 of the bottle 6, for example toward the first portion 60 of the bottle 6. Said second connection mean 120 globally extends radially and perpendicular to the axial dimension 5 of the bottle 6.

The first connection mean 110 is designed to allow the fixture of the second attachment mean 10 to the side wall 42 of the frame 4. In this embodiment, the first connection mean 110 comprises a mounting clip 112 which enters a hole in the side wall 42 to partially secure the second attachment mean 10 on the side wall 42 of the frame 4.

The second connection mean 120 is designed to allow the fixture of the second attachment mean 10 to the end wall 40 of the frame 4 through the mounting arm 44. In this embodiment, the second connection mean 120 is connected to the mounting arm 44 by a screw 124 which collaborates with a tapped hole 122.

Together, the first connection mean 110 and the second connection mean 120 tighten the second attachment mean 10 to the frame 4.

In this embodiment, both the first connection mean 110 and the second connection mean 120 act in parallel directions, which means that only one movement is needed to attach the second attachment mean 10 onto the frame 4.

Other types of connection means may be used without exiting the scope of the invention, as long as the second attachment mean 10 may be separated from the frame 4 without damaging one or the other. For example, any of the first connection mean 110 or the second connection mean 120 can be replaced by a screw, a mounting clip, a hook or any other connection mean.

In the invention, the second attachment mean 10 may limit an axial movement of the bottle 6 along the axial dimension 5 of the bottle 6. It can be made in different manner, but an example is at least one portion extending in a plane perpendicular to an axial dimension 5. The portion crosses the axial dimension 5 and necessary enters in mechanical interference with a longitudinal end 64 of the bottle 6.

The portion forms a stop portion 102 that abuts this longitudinal ends 64 of said bottle 6. Said stop portion 102 brings together a first end 104 of the circular portion 100 and a second end 106 of the circular portion 100, and lies atop the bottle 6. Atop the bottle 6 means that the stop portion 102 lies on a longitudinal end 64 of the bottle 6, said longitudinal end 64 being located at the second portion 62 of the bottle 6.

The second attachment mean 10 of the first embodiment comprises a large stop portion 102, and a small stop portion 103, the small one being made like an indentation.

The stop portion 102, 103 limits the movement of the bottle 6 in the axial dimension. This relieves the stress upon the first attachment mean 8 of the bottle 6 onto the heat 2, to avoid the rupture of either the bottle 6, the first attachment mean 8 or the heat exchanger 2, and to lengthen the lifespan of the whole heat exchanging module 1.

The second attachment mean 10 limits the movement of the bottle 6 in a direction perpendicular to the axial dimension. This arrangement limits the mechanical stress endured by the first attachment mean 8 and the risk of breaking.

It should be noted that the frame 4 is made of steel, from a single piece or made of differences pieces assembled all together to form the frame 4.

Figure 3:
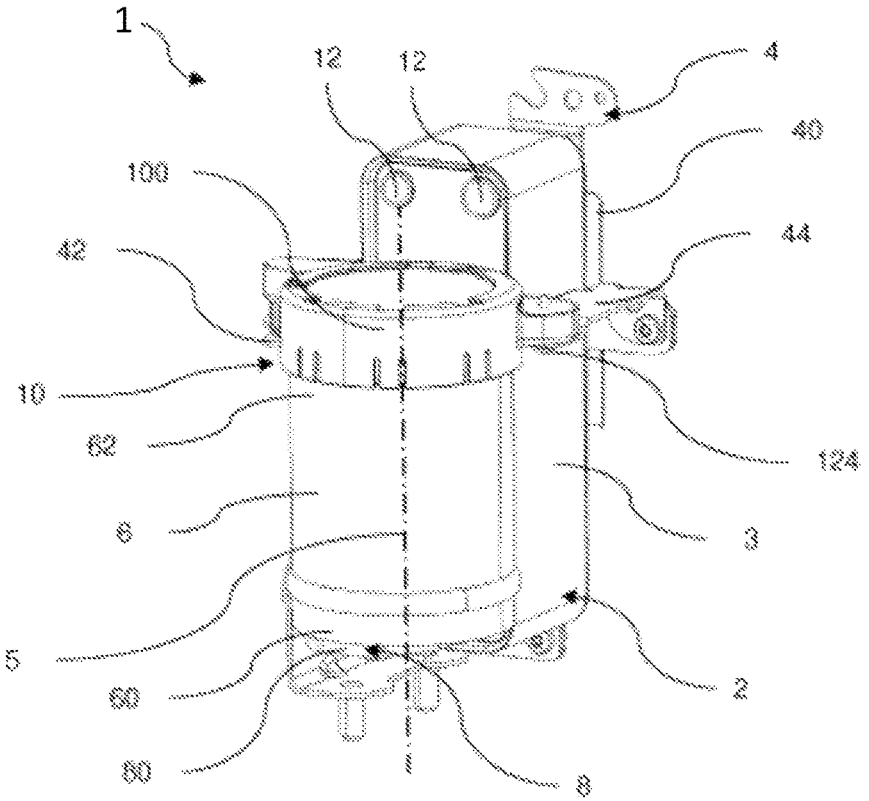
FIG. 3 represents a heat exchanging module comprising a second attachment mean according to a second embodiment.
Figure 4:
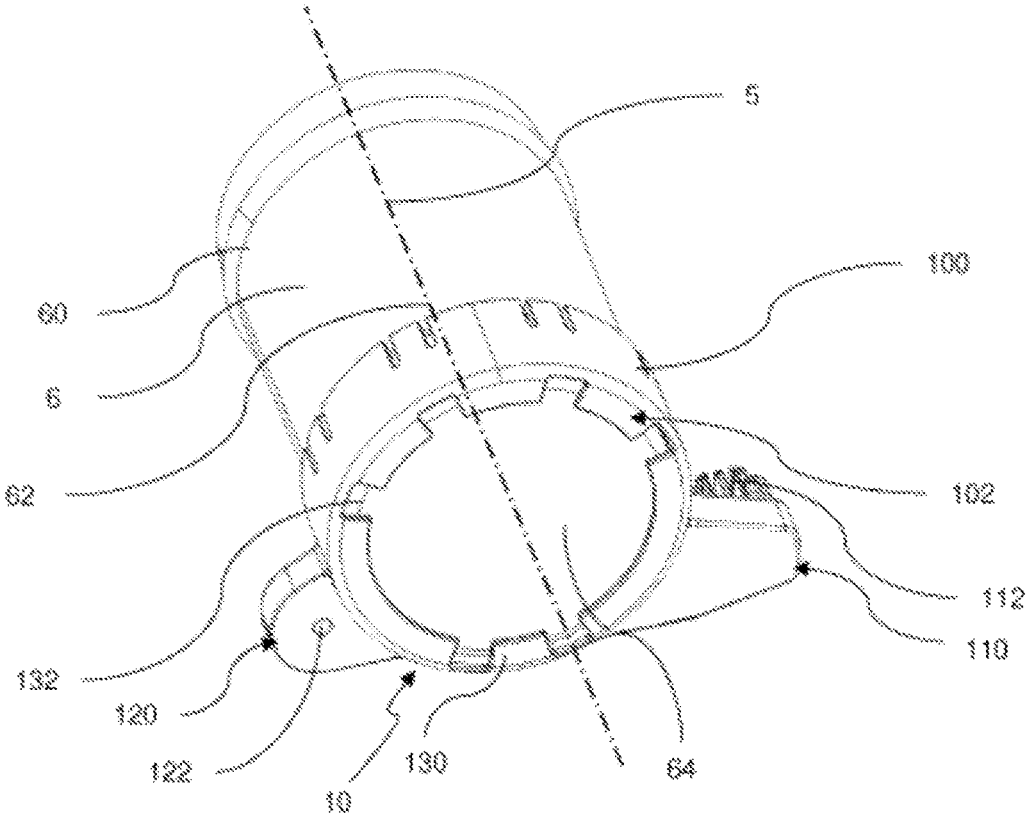
FIG. 4 is a perspective view of a bottle on which is located the second attachment mean according to a second embodiment.
Figure 5:
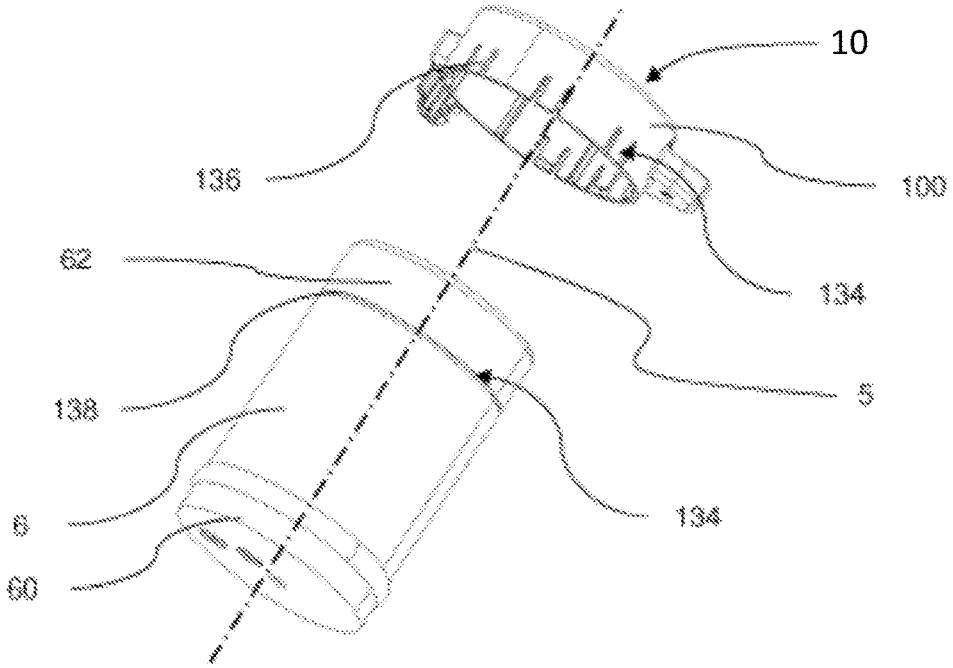
FIG. 5 is an exploded view of a bottle and the second attachment mean according to the second embodiment.

A second embodiment of the invention is represented in the FIGS. 3 to 5. FIG. 3 displays a heat exchanging module 1 similar to the heat exchanging module 1 of FIG. 1, in which it comprises a heat exchanger 2, a frame 4 having an end wall 40, a mounting arm 44 and a side wall 42, a bottle 6 connected to the heat exchanger 2 by a first attachment mean 8 comprising a mounting bracket 80, a mounting screw and at least one duct, and a second attachment mean 10 which attach the bottle 6 to the frame 4.

The second embodiment of the invention differs from the first embodiment especially by the structure of the second attachment mean 10. The similarities and differences between the two embodiments are further shown on FIG. 4.

Like the second attachment mean 10 of the first embodiment, the second attachment mean 10 of the second embodiment comprises a circular portion 100, a stop portion 102, a first connection mean 110 and a second connection mean 120.

The circular portion 100 extends around the second portion 62 of the bottle 6 and onto the longitudinal end 64 of said bottle 6. This particular arrangement means that the second attachment mean 10 is specific to a bottle 6 type of a given diameter.

The stop portion 102 comprises a plurality of radial projections 130, here six, each pair of radial projections 130 being separated by a gap 132. These radial projections 130 of the stop portion 102 fulfill the same goal as the stop portion 102 of the first embodiment, by limiting the movement of the bottle 6 in its axial direction 5.

The first connection mean 110 and the second connection mean 120 are configured in the very same way as in the first embodiment: the first connection mean 110 comprises a mounting clip 112 which connects the second attachment mean 10 to the side wall 42 of the frame 4, the second connection mean 120 comprises a screw 124 which collaborates with a tapped hole 122 made in the second connection mean 120. The first connection mean 110 and the second connection mean 120 have an arm that extends in a parallel plane, said plane being perpendicular to said axial dimension 5. The first connection mean 110 extends toward the first portion 60 of the bottle 6.

A shown in FIG. 5, the second attachment mean 10 further comprises a securing mean 134, which participates in the support of the bottle 6. This securing means is configured to restrict movement between the bottle and the second attachment means 10 in two opposite sense of the axial dimension 5.

Said securing mean 134 comprises a groove 138 located on the second portion 62 of the bottle 6. Said groove 138 can be continuous or doted around the bottle 6.

The securing mean 134 also comprises at least one clipping mean 136, which is located on the circular portion 100 of the second attachment mean 10.

When the bottle 6 is inserted in the second attachment mean 10, the clipping mean 136 of the securing mean 134 are deformed and pushed away from the bottle 6 due to the diameter of the bottle 6 being larger than the diameter defined by the clipping mean 136. When the bottle 6 is fully inserted in the second attachment mean 10, for example when the longitudinal end 64 is abutting at least one radial projections 130, the clipping mean 136 get into the groove 138, securing the second attachment mean 10 to the bottle 6. The securing mean 134 authorize the separation of the bottle 6 and the second attachment mean 10.

In a possible embodiment of the invention, the groove 138 is located on the second attachment mean 10 while the clipping mean 136 are located on the bottle 6.

Figure 6:
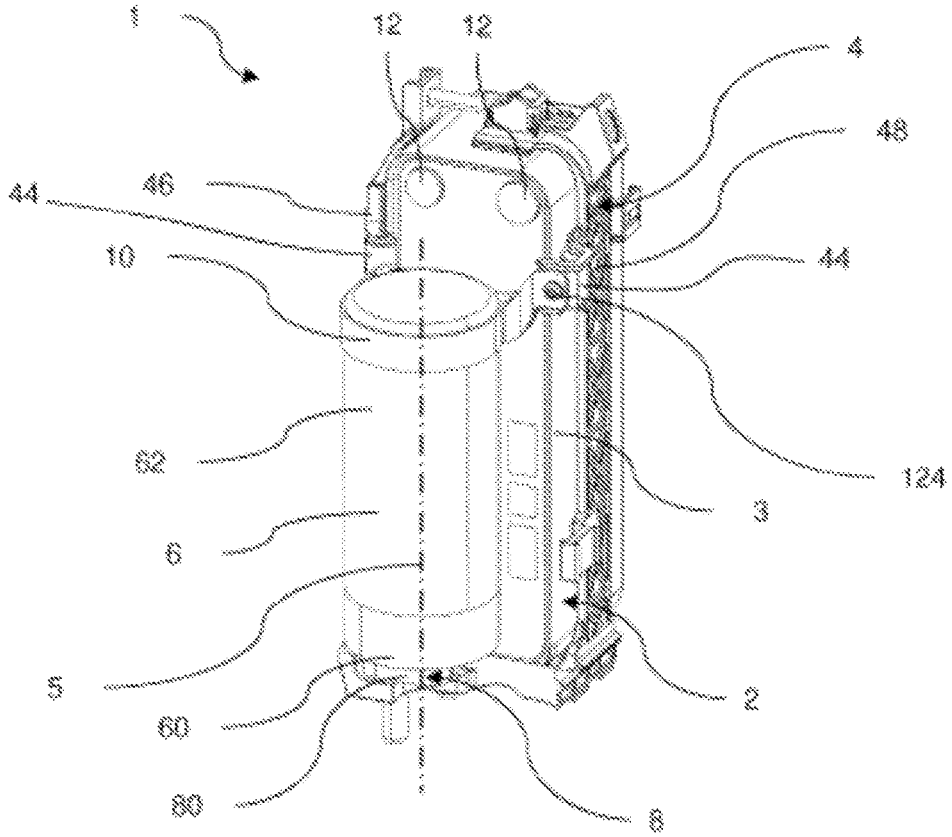
FIG. 6 is a representation of a heat exchanging module comprising a second attachment mean according to a third embodiment.
Figure 7:
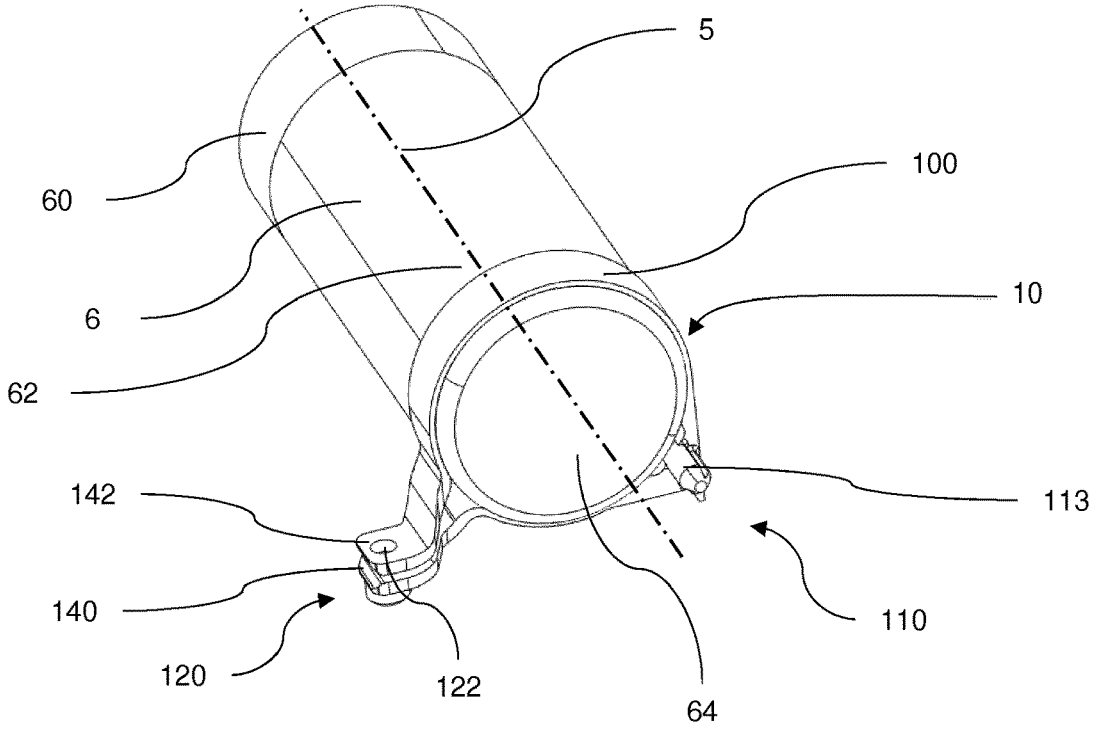
FIG. 7 is a perspective view of a bottle on which is located the second attachment mean.

A third embodiment of the invention is represented in the FIGS. 6 and 7. FIG. 6 displays a heat exchanging module 1 similar to the heat exchanging module 1 of FIG. 1, in which it comprises a heat exchanger 2, a frame 4, a bottle 6 connected to the heat exchanger 2 by a first attachment mean 8 comprising a mounting bracket 80, a mounting screw and at least one duct, and a second attachment mean 10 which attach the bottle 6 to the frame 4.

In this third embodiment, the frame 4 comprises a first side wall 46 and a second side wall 48, each side wall being separated from one another by the heat exchanger 2. The first side wall 46 and/or the second side wall 48 may comprise mounting arm 44 that extends from the related walls.

It should be noted that the frame 4 of this third embodiment is made of plastic and may be molded as a single part.

The second attachment mean 10 comprises a first connection mean 110 and a second connection mean 120, designed to allow the fixture of the second attachment mean 10 to the frame 4. Turning to FIG. 7, the first connection mean 110 of the second attachment mean 10 is connected to the first side wall 46 by a mounting pin 113 extending in a first direction, the second connection mean 120 of the second attachment mean 10 being connected to the second side wall 48 by a screw 124 which enters a hole 122 extending in a second direction perpendicular to the first direction, the screw being screwed in the mounting arm 44. Said in other words, the first connection mean 110, especially a pin 113, extends in a first direction that can be parallel to the axial dimension 5 of the bottle 6. The second connection mean 120, especially the hole 122, extends in the second direction, said second direction being perpendicular to said first direction.

The second attachment mean 10 may be made of a material having vibration dampening properties such as those described in the first embodiment of the invention.

FIG. 7 illustrates the specificity of the second attachment mean 10 of the third embodiment.

The second attachment mean 10 according to the third embodiment of the invention comprises a circular portion 100 circling all around the bottle 6. The circular portion 100 of the second attachment mean 10 is opened and comprises a first free end 140 and a second free end 142. The circular portion 100, once the first free end 140 and the second free end 142 brought together, circle the bottle 6, the first free end 140 and the second free end 142 being positioned in front of the second side wall, more precisely in front of the mounting arm of said side wall. Brought together, the first free end 140 and the second free end 142 constitutes the second connection mean 120. The first free end 140 is facing the second side wall 48, and is therefore located between the second side wall 148 and the second free end 142.

Combined with the material of the second attachment mean 10, the wrapping of the first free end 140 and the second free end 142 around the bottle 6 limits the movement of the bottle 6 and absorb some of the vibrations endured by the bottle 6.

The flexibility offered by the separation of the first free end 140 and the second free end 142 before the fixation to the second side wall 48 allows an easy insertion of the bottle 6 during a mounting process of the heat exchanging module 1. Due to the absence of a stop portion 102 or any element overlapping on the longitudinal end 64, the second attachment mean 10 according to the third embodiment allows the installation of any type of bottle 6 with a given diameter, regardless of the length of said type of bottle measured in the axial dimension 5.

Figure 8:
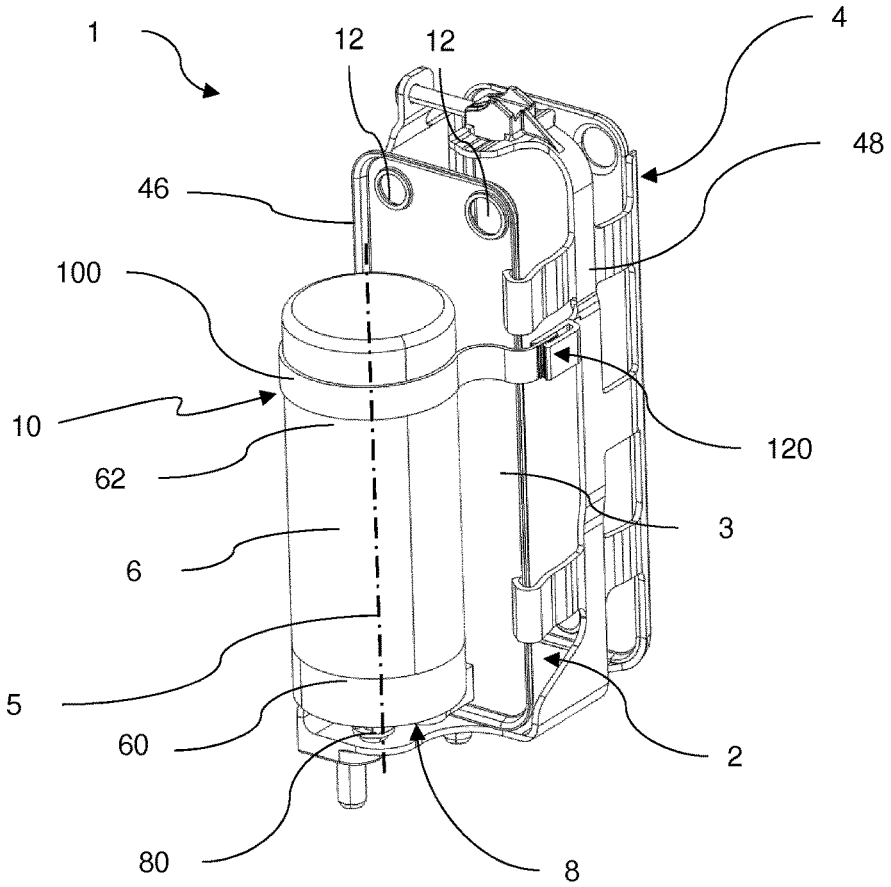
FIG. 8 represents a heat exchanging module comprising a second attachment mean according to a fourth embodiment.
Figure 9:
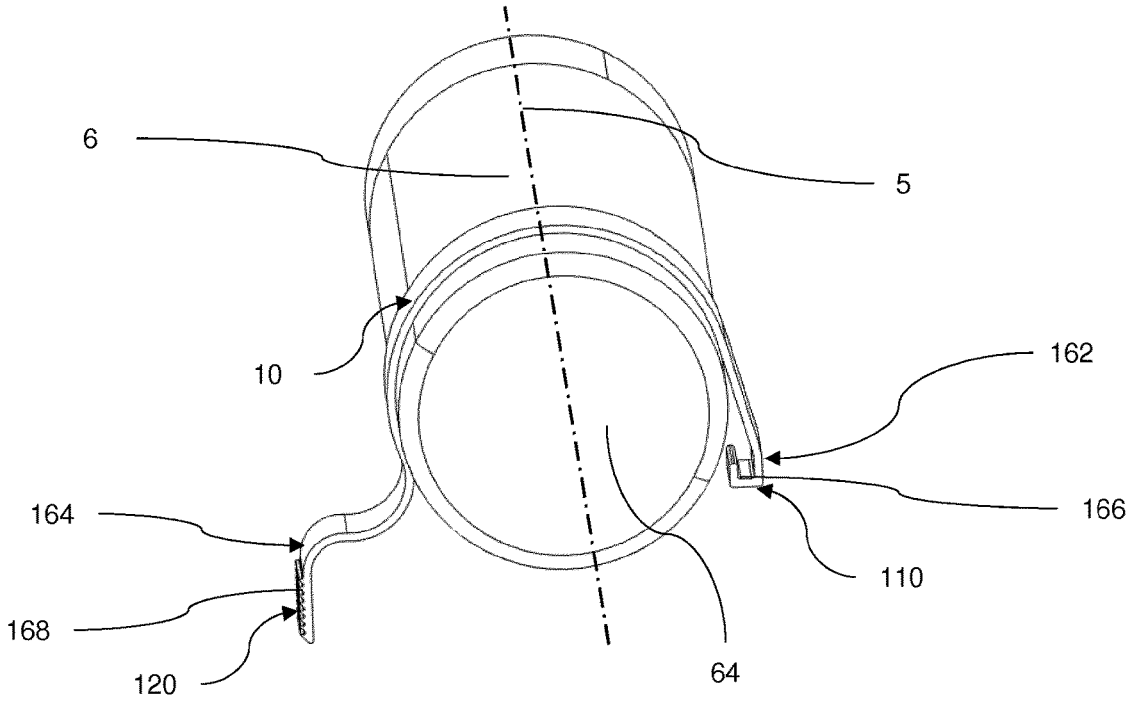
FIG. 9 is a perspective view of a bottle on which is located the second attachment mean according to a fourth embodiment.
Figure 10:
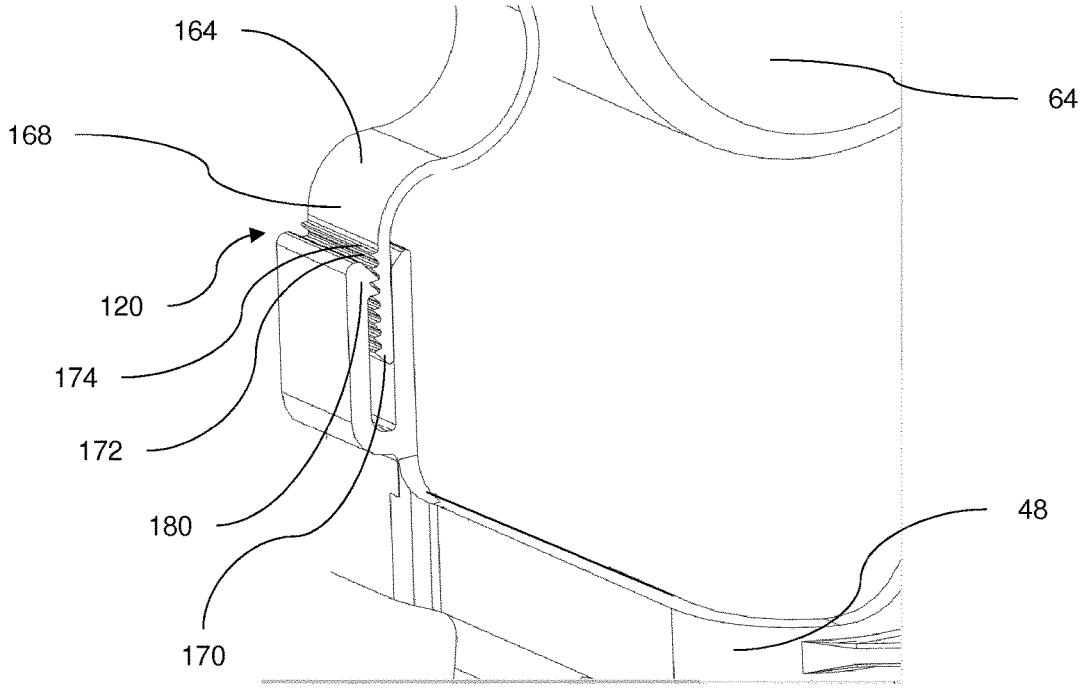
FIG. 10 features a detail of the connection between the second attachment mean according to the fourth embodiment and the frame of the heat exchanging module.

A fourth embodiment of the invention is represented in the FIGS. 8 to 10. FIG. 8 displays a heat exchanging module 1 similar to the heat exchanging module 1 of FIG. 3, in which it comprises a heat exchanger 2 (illustrated here by its two terminal plates), a frame 4 having a first side wall 46 and a second side wall 48, a bottle 6 connected to the heat exchanger 2 by a first attachment mean 8 comprising a mounting bracket 80, a mounting screw and at least one duct, and a second attachment mean 10 which attach the bottle 6 to the frame 4.

The second attachment mean 10 according to the fourth embodiment comprises a band 160, comprising a first end 162 and a second end 164, as it can best be seen on FIGS. 9 and 10. The first end 162 and the second end 164 are located on opposite longitudinal side of the band 160.

On the first end 162 of the band 160, the second attachment mean 10 comprises a first connection mean 110, while on the second end 164 of the band 160, the second attachment mean 10 comprises a second connection mean 120.

The first connection mean 110 comprises a hook 166 which attach itself on a complementary shaped part of the first side wall 46.

The second connection mean 120 comprises a click-in device 168. Such a click-in device 168 comprises a plurality of teeth 170, these teeth 170 having a slanted face 172 and an upright face 174. The slanted face 172 of the teeth 170 face a jaw 180 made on the second side wall 48, or on a dedicated part attached to this side wall 48. Such configuration allows the insertion of a tooth 170 in the jaw 180 but blocks its removal without loosening the jaw 180 first. It also make it easy to assemble the band 160 around the bottle 6.

The insertion of the teeth 170 in the jaw 180 allows to strap the bottle 6 against the heat exchanger 2. During the assembling of the heat exchanging module 1, the second attachment mean 10 is disposed first by the attachment of the hook 166 to the first side wall 46, then by the attachment of the click-in device 168 to the second side wall 48, when the second attachment mean 10 of the three other embodiments could be attached without a assembling order of any kind.

Several bottle types of different diameters may be used with the same second attachment mean 10, due to the use of the click-in device 168, which allows to control the room available to fit the bottle 6. The second attachment mean 10 according to the fourth embodiment allows the installation of bottle 6 with different diameters, regardless of the length of said type of bottle measured in the axial dimension 5.

The preceding description clearly illustrate how the invention fulfills its objectives, as laid out in the preamble, and offers a heat exchanging module 1 comprising a bottle 6 and having a mean to attach the bottle 6 to said heat exchanging module 1 at two portions of the bottle 6, avoiding mechanical troubles due to vibrations.

Several modifications and improvement might be applied by the person skilled in the art to the heat exchanging module 1 as defined above, as long as a second attachment mean 10 of a bottle 6 is implemented.

In any case, the invention cannot and should not be limited to the embodiments specifically described in this document, as other embodiments might exist. The invention shall spread to any equivalent mean and any technically operating combination of means.

The invention claimed is:

1. A heat exchanging module comprising:

a heat exchanger;

a frame; and a bottle, the heat exchanger being attached to the frame, the bottle being attached to the heat exchanger by a first attachment mean at a first portion of the bottle, the bottle being attached to the frame with a second attachment mean located at a second portion of the bottle, and wherein the frame comprises at least a first side wall, a second side wall and an end wall in between the first side wall and the second side wall, the second attachment mean is connected to the first side wall of the frame by a first connection mean, and to the second side wall of the frame by a second connection mean, wherein the first side wall and the second side wall extend parallelly each other, wherein the first side wall of the frame extends on a first side of the heat exchanger, the second side wall of the frame extending on a second side of the heat exchanger opposed to the first side of the heat exchanger.

2. The heat exchanging module according to claim 1, wherein the second attachment mean restricts a movement of the bottle in a direction perpendicular to an axial dimension of the bottle.

3. The heat exchanging module according to claim 1, wherein the second attachment mean limits an axial movement of the bottle along an axial dimension of said bottle.

4. The heat exchanging module according to claim 1, wherein the second attachment mean comprises at least one portion extending in a plane perpendicular to an axial dimension of said bottle.

5. The heat exchanging module according to claim 4, wherein the at least one portion is located at a longitudinal end of the bottle.

6. The heat exchanging module according to claim 3, wherein the second attachment mean comprises a stop portion extending in a plane perpendicular to the axial dimension of the bottle and abutting against a terminal end of the bottle.

7. The heat exchanging module according to claim 5, wherein the at least one portion comprises at least two radial projections separated from one another by a gap.

8. The heat exchanging module according to claim 1, wherein the first attachment mean comprises a mounting bracket and a mounting mean, the mounting bracket comprising at least one duct which connect the bottle to the heat exchanger.

9. The heat exchanging module according to claim 1, wherein the second attachment mean comprises a circular portion meant to fit at least partially around the bottle.

10. The heat exchanging module according to claim 1, wherein the second attachment mean comprises the first connection mean, and the second connection mean, both first connection mean and second connection mean being connected to the frame.

11. The heat exchanging module according to claim 10, wherein the second attachment mean is connected to the end wall of the frame by the second connection mean.

12. The heat exchanging module according to claim 10, wherein the first connection mean extends in a first direction while the second connection mean extends in a second direction perpendicular to the first direction.

13. The heat exchanging module according to claim 10, wherein the first connection mean and the second connection mean extend in opposite directions and are parallel.

14. The heat exchanging module according to claim 10, wherein the second attachment mean comprises a first free end and a second free end, both the first free end and the second free end being connected together by the second connection mean.

15. The heat exchanging module according to claim 1, wherein the second attachment mean comprises at least one securing mean that secures the bottle on the second attachment mean.

16. The heat exchanging module according to claim 15, wherein the securing mean comprises at least one mounting clip, and at least one groove which at least partially receives the mounting clip.

17. The heat exchanging module according to claim 1, wherein the second attachment mean is configured to equally accommodate a first type of bottle of a first diameter or a second type of bottle of a second diameter greater than the first diameter.

18. The heat exchanging module according to claim 1, wherein the second attachment mean is made of a material having vibration dampening properties.

19. The heat exchanging module according to claim 18, wherein the second attachment mean is made of synthetic material.

20. The heat exchanging module according to claim 1, wherein the heat exchanger is crossed by a first circuit configured to receive a refrigerant fluid and by a second circuit configured to receive a coolant fluid.

* * * * *